US007728520B2

(12) United States Patent
Yaniv et al.

(10) Patent No.: US 7,728,520 B2
(45) Date of Patent: Jun. 1, 2010

(54) OPTICAL MODULATOR OF ELECTRON BEAM

(75) Inventors: Zvi Yaniv, Austin, TX (US); Igor Pavlovsky, Austin, TX (US); Richard Fink, Austin, TX (US)

(73) Assignee: Applied Nanotech Holdings, Inc., Austin, TX (US)

( * ) Notice: Subject to any disclaimer, the term of this patent is extended or adjusted under 35 U.S.C. 154(b) by 1305 days.

(21) Appl. No.: 11/035,914

(22) Filed: Jan. 14, 2005

(65) Prior Publication Data

US 2005/0156521 A1 Jul. 21, 2005

Related U.S. Application Data

(60) Provisional application No. 60/536,856, filed on Jan. 16, 2004.

(51) Int. Cl.
*H01J 1/02* (2006.01)
*G06M 7/00* (2006.01)
*H01J 46/14* (2006.01)

(52) U.S. Cl. ..... 313/542; 313/310; 250/423 P; 250/370.11

(58) Field of Classification Search ..... 313/523–532, 313/537, 538, 365, 373, 380, 388, 542, 103 R, 313/103 CN; 315/5; 359/291; 250/396
See application file for complete search history.

(56) References Cited

U.S. PATENT DOCUMENTS 4,313,072 A 1/1982 Wilson et al. ..... 315/5
5,132,586 A * 7/1992 Boulais et al. ..... 313/105 CM
5,313,138 A * 5/1994 Desmur ..... 315/3
5,760,548 A * 6/1998 Beeteson et al. ..... 315/366
5,898,268 A * 4/1999 Moreshead et al. ..... 313/542
6,002,207 A * 12/1999 Beeteson et al. ..... 313/542
6,376,985 B2 * 4/2002 Lee et al. ..... 313/542
6,570,165 B1 * 5/2003 Engdahl et al. ..... 250/423 P
2001/0038263 A1 * 11/2001 Lee et al. ..... 313/542
2002/0053867 A1 5/2002 Van Der Vaart et al. ..... 313/446
2003/0001497 A1 * 1/2003 Kinoshita et al. ..... 313/532
2003/0021520 A1 * 1/2003 Tungare et al. ..... 385/16
2003/0048075 A1 * 3/2003 Lim et al. ..... 313/542

FOREIGN PATENT DOCUMENTS

WO WO 03/054901 A2 * 3/2003

OTHER PUBLICATIONS

F.V. Hartemann et al., "Coherent Photoelectron Bunch Generation and Quantum Efficiency Enhancement in a Photocathode Optical Resonator," *Appl. Phys. Lett.*, 65(19), Nov. 7, 1994, pp. 2404-2406.

* cited by examiner

*Primary Examiner*—Sikha Roy
*Assistant Examiner*—Tracie Green
(74) *Attorney, Agent, or Firm*—Kelly Kordzik; Matheson Keys Garsson & Kordzik PLLC

(57) ABSTRACT

An optoelectronic modulator is based on the concentration of an electron beam from an electron gun by a tapered cavity, which sides are photosensitive and change the electrical conductivity under the illumination of light (electromagnetic radiation). The light modulation causes the corresponding changes in the current transported across the walls of the cavity. The remaining part of the electron current exits the cavity aperture and forms an amplitude-modulated divergent electron beam.

18 Claims, 1 Drawing Sheet

OPTICAL MODULATOR OF ELECTRON BEAM

CROSS-REFERENCE TO RELATED APPLICATIONS

The present application claims priority to U.S. Provisional Patent Application Ser. No. 60/536,856.

TECHNICAL FIELD

The present invention relates in general to modulation of an electron beam

BACKGROUND INFORMATION

Numerous applications require high brightness, high frequency electron sources. Those include military, aerospace, communications and other commercial industries. Advances in modern technology require higher performance of electron sources that can be used for generation of powerful microwave radiation. One of the ways to achieve a high-brightness electron beam with desired parameters is to use a photocathode irradiation technique. However, this method produces low electron currents (emittance), much lower than that of thermionic cathodes, which limits a range of possible applications.

U.S. Pat. No. 4,313,072 describes an electron gun in which the electron beam is modulated by laser pulses illuminating a photocathode. Electrons are generated by the photocathode, and the electron current is limited by the performance and properties of the photocathode, resulting in current density that is usually low. U.S. Pat. Publication No. US2002/0053867 A1 discloses a separate cathode for emitting electrons and an electron beam guidance cavity for concentrating electrons, which uses an insulating material around the cavity exit aperture such that the insulating material is a coating (e.g., MgO) having certain secondary electron emitting properties. The output current density J of such an electron source depends on the diameter (area) of the exit aperture, thus making it possible to obtain high values of J with small apertures. However, it is difficult to achieve high frequency modulation of the beam using this approach. The thermal spread of electron energies will limit the cut-off frequency in case of thermionic cathodes. The problem with using cold cathodes in this application is the cathode-to-grid capacitance, which leads to a low input impedance at higher frequencies.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
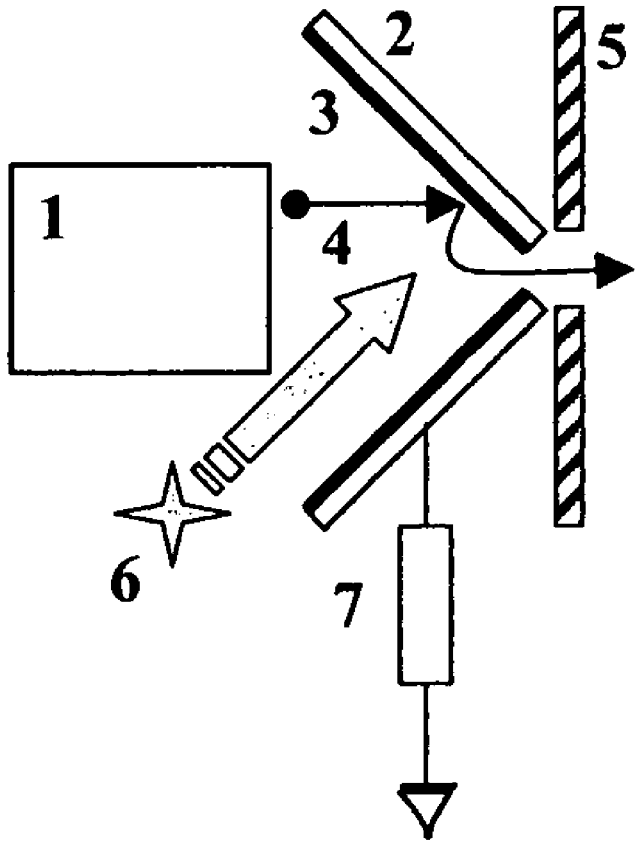
FIG. 1 illustrates a schematic diagram of an embodiment of the present invention.

Described is an electron source with an optically active electron concentration cavity, meaning that the cavity has a coating made of a semiconducting material that changes its electrical properties when irradiated by a light source. The property that changes under the influence of the light source is the conductivity of the coating. For example, if the coating is not irradiated by light, it has high electrical conductivity, and if it is irradiated by light it has low conductivity. Depending on the conductivity of the cavity, the electron transport to the cavity exit aperture changes. If the cavity is not irradiated by the light, the electrons will be transported to the aperture under the influence of an external electric field induced in such a way that electrons travel in the direction to the exit aperture. If the cavity is irradiated by a light source, the electrons will transport through the optically active coating to the conducting or semiconducting body of the cavity.

An embodiment of the optoelectronic modulator is shown in FIG. 1. The electrons 4 emitted from the electron gun 1 hit the surface of the optically active concentrator in the form of cavity 2, which is covered with a photoactive material 3. If the light source 6 is off, electrons 4 will move to the exit aperture if a positive potential is applied to the extraction electrodes 5 versus ground. If the light source 6 is on, the electrons 4 will transport through the layer 3 to the cavity 2 and will be grounded through the resistor 7. The electron current through the exit aperture will be low since a major part of the electron current will be drawn to ground.

In one embodiment, the cavity material 2 is doped with a semiconducting silicon, while the cavity coating material 3 is an amorphous silicon layer. If the coating is illuminated, it will produce charge carriers within the amorphous silicon layer, resulting in low resistivity of the coating layer. In this case, only the electrons that are directed straight into the aperture will escape outside the cavity. Accordingly, the coating will have high resistivity when no illumination is used. Once electrons hit the cavity surface, they will hop over the amorphous silicon layer toward the exit aperture in the direction of electric field induced by the extraction electrode 5. For amorphous silicon, typically, the illumination wavelength should be in the visible range of spectrum.

In another embodiment, the cavity 2 may have a rectangular shape with tilted to each other cavity sides. The exit aperture will have a form of a slit. This embodiment produces an electron beam with rectangular cross-section (sheet beam). To avoid electron divergence, a system of focusing electrodes (not shown) can be used beyond the exit aperture.

In another embodiment, the cavity 2 has an axial symmetry and is funnel-shaped. The exit aperture will be round in this case. This approach will produce an electron beam with a round cross-section (pencil beam). As in the previous embodiment, a system of focusing electrodes (not shown) can be used beyond the exit aperture to avoid electron divergence.

Modulation of the electron beam 4 can be made independently by illumination of the cavity layer 3 and applying an alternating potential to the extraction electrode 5. An embodiment for simultaneous modulation involves application of an RF modulated light signal and a lower frequency modulated electric potential.

In a further embodiment, the electron source 1 is a field emission electron gun. More specifically, the electron source 1 has at least two electrodes, one of which is a cathode comprising field electron emitters such as nanotubes, single wall or multiwall, or a mixture thereof, on its surface, and the other electrode is a metal grid positioned at a distance from the cathode. Positive potential should be applied to the grid vs. cathode in order to extract electrons from the cathode by inducing the electric field. In this case, additional modulation of the electron beam 4 can be performed at frequencies not limited by a cathode-grid capacitance by modulating the voltage between the grid and the cathode.

In another embodiment, the light source 6 can be a laser with a wavelength suitable to change the conductivity of the coating 3, or it can be an LED with a suitable wavelength of light. An optical fiber can also be used to deliver the light to the cavity coating.

In a further embodiment, an optical switch is a free-standing device that does not have a built-in electron source, but is introduced in an apparatus having an electron beam inside, and in such a way that the switch can modulate that beam.

The concentrator cavity 2 can be made with different materials. The cavity 2 can be made of metal, or semiconductor with an electrical conductivity sufficient to provide electrical current across it. The cavity can also be made of a dielectric, such as aluminum oxide, or silicon oxide, or a like material, with a metal film deposited over it. The optically active coating is then deposited over the metal film.

The response time of the modulator is mainly defined by the velocity of the electrons (electron energy), size of the cavity, shape of the cavity, electron transport over the cavity surface (hopping or reflection), and electron mobility across the cavity material. If a cathode 1 is a field emission gun with a gate voltage of 600V, the electron velocity will be $v=(2\ eU/me)^{1/2}\sim1.5*10^9$ cm/s. If the cavity size is ~½ cm, the time-of-flight across the cavity will be $0.3*10^{-9}$ s, which can be indicative of the cut-off frequency (3 GHz) that can be achieved with this straightforward design.

An example of the modulator comprises a field emission electron gun capable of delivering up to 30 mA current pulses, with a pulse width of 10 μs and a duty factor of 1/1000. The rectangular exit slit of the cavity has a width of 0.05 mm and a length of 4 mm. This produces an electron current density of 15 $A/cm^2$ over the area of the exit slit. The exiting electron beam is usually diverging. The divergence angle depends on the slit (hole) diameter, electron energy, potential of the extracting electrode 5, and the electric field configuration in the area beyond the exit slit. Focusing electrode(s) can be placed beyond the slit to converge the electron beam (not shown in the FIG. 1).

This shows that this modulator can work as an electron beam generator for many applications such as powerful microwave devices, accelerators, and e-beam sources.

The invention claimed is:

1. An apparatus comprising:

an optically active electron concentrator with an exit aperture;

an electron source configured for emitting an electron beam towards the optically active electron concentrator; and a light source aimed at the optically active electron concentrator, the light source configured for modulating output of the electron beam through the exit aperture.

2. The apparatus as recited in claim 1, wherein the optically active electron concentrator further comprises a conductive material coated by a layer of optically active semiconductive material having a physical property so that it changes its conductivity when irradiated by light.

3. The apparatus as recited in claim 2, wherein the optically active semiconductive material is amorphous silicon.

4. The apparatus as recited in claim 1, wherein the electron source is a cold cathode.

5. The apparatus as recited in claim 1, wherein the electron source comprises a carbon nanotube electron source.

6. The apparatus as recited in claim 2 further comprising a resistive element coupled to the conductive material.

7. The apparatus as recited in claim 1 further comprising an extraction electrode positioned near the exit aperture.

8. The apparatus as recited in claim 1, wherein the light source has a wavelength in the visible range.

9. An apparatus comprising:

an electron concentrator with an exit aperture;

an electron source configured for emitting an electron beam towards the electron concentrator; and an electromagnetic radiation source aimed at the electron concentrator, the electromagnetic radiation source configured for modulating output of the electron beam through the exit aperture.

10. The apparatus as recited in claim 9, wherein the electron concentrator is configured to have a surface that changes its conductivity when irradiated with the electromagnetic radiation.

11. The apparatus as recited in claim 2, wherein the light source is on, resulting in the light irradiating the layer of optically active semiconductive material, wherein the layer of optically active semiconductive material thus has high electrical conductivity and thus configured to reduce a number of electrons transported through the exit aperture, resulting in modulation of the electron beam though the exit aperture.

12. The apparatus as recited in claim 2, wherein the light source is off, resulting in the light not irradiating the layer of optically active semiconductive material, wherein the layer of optically active semiconductive material thus has low electrical conductivity and thus configured to reduce a number of electrons transported though the exit aperture, resulting in modulation of the electron beam though the exit aperture.

13. The apparatus as recited in claim 12, further comprising an electrical connection between the concentrator and a ground potential where the electrical connection is configured to transport electrons supplied by the electron beam and striking the electron concentrator in greater numbers to the ground potential when the layer of optically active semiconductive material is irradiated by the light from the light source.

14. The apparatus as recited in claim 10, wherein the surface of the electron concentrator is configured to have high electrical conductivity when irradiated by the electromagnetic radiation that reduces a number of electrons transported through the exit aperture, resulting in modulation of the electron beam though the exit aperture.

15. The apparatus as recited in claim 10, wherein the surface of the electron concentrator is configured to have low electrical conductivity when not irradiated by the electromagnetic radiation that increases a number of electrons transported through the exit aperture, resulting in modulation of the electron beam though the exit aperture.

16. The apparatus as recited in claim 14, further comprising an electrical connection between the electron concentrator and a ground potential where the electrical connection is configured to transport electrons supplied by the electron beam and striking the electron concentrator in greater numbers to the ground potential when the electron concentrator is irradiated by the electromagnetic radiation.

17. The apparatus as recited in claim 1, wherein the optically active electron concentrator with the exit aperture has a vacuum cavity.

18. The apparatus as recited in claim 9, wherein the optically active electron concentrator with the exit aperture has a vacuum cavity.

* * * * *